United States Patent [19]

Hilsum et al.

[11] 4,137,481

[45] Jan. 30, 1979

[54] ELECTROLUMINESCENT PHOSPHOR PANEL

[75] Inventors: Cyril Hilsum; John Kirton, both of Malvern; Adrian L. Mears, Cheltenham, all of England

[73] Assignee: The Secretary of State of Defence in Her Britannic Majesty's Government of the United Kingdom of Great Britain and Northern Ireland, London, United Kingdom

[21] Appl. No.: 843,188

[22] Filed: Oct. 18, 1977

[30] Foreign Application Priority Data

Oct. 29, 1976 [GB] United Kingdom ..... 45213/76

[51] Int. Cl.[2] ..... H05B 33/02; H05B 33/14

[52] U.S. Cl. ..... 313/503; 313/506; 313/512

[58] Field of Search ..... 313/506, 503, 509, 512, 313/498

[56] References Cited

U.S. PATENT DOCUMENTS

| | | | |
|---|---|---|---|
| 2,824,992 | 2/1958 | Bouchard et al. | 313/509 |
| 3,854,070 | 12/1974 | Vlasenko et al. | 313/503 |
| 4,015,166 | 3/1977 | Ohshima et al. | 313/503 |

*Primary Examiner*—Palmer C. Demeo

*Attorney, Agent, or Firm*—Pollock, Vande Sande and Priddy

[57] ABSTRACT

A d.c. electroluminescent panel comprises a transparent substrate, a transparent first electrode film, a phosphor layer, and a second electrode film. Application of a voltage across the phosphor layer causes it to emit light.

In this invention the phosphor layer is produced in two layers, a first semi-insulating thin layer of activator doped phosphor and a second electrically conducting layer of phosphor.

11 Claims, 1 Drawing Figure

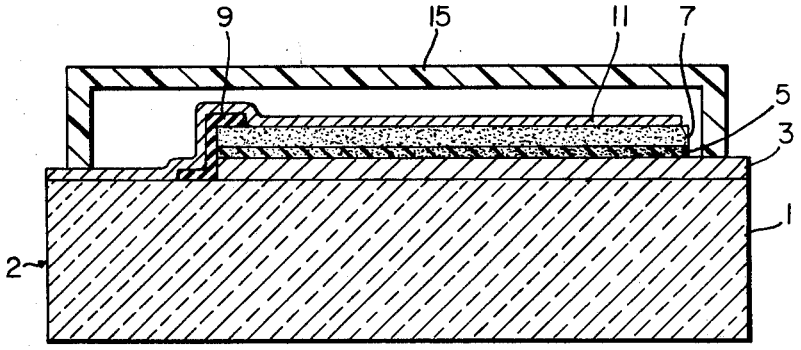
9
15
11
7
5
3
1
2

ELECTROLUMINESCENT PHOSPHOR PANEL

The present invention relates to electroluminescent phosphor (E.L.) panels.

E.L. panels are used as alternatives to cathode ray tubes, plasma panels, liquid crystal devices and light-emitting diodes (LEDs) for displaying information or data e.g. word or numerals, electro-optically. They may be operated by either alternating or unidirectional voltages, and the panel is designed differently for these two kinds of voltage. E.L. panels suitable for unidirectional voltage operation (DCEL panels) are normally made in the following way.

A transparent front electrode film e.g. of tin oxide, is deposited on a transparent insulating substrate e.g. glass. A layer of active grains suspended in a binder medium e.g. polymethylmethacrylate, is spread on the front electrode film. Each active grain consists of a phosphor such as zinc sulphide doped with an activator such as manganese and is coated with copper. A back electrode film, e.g. of aluminum is deposited on the layer of active grains. The electrode films may be shaped (e.g. by conventional photo-etching following their deposition) in the form of characters or symbols to give the required dispiay. Alternatively the electrode films may be shaped in the form of mutually perpendicular strips defining a matrix of phosphor elements at the intersections.

Before a DCEL panel produced in the above way may be used (e.g. commercially) it must be treated by a process known in the art as 'forming' to produce a light-emitting region within the panel. A unidirectional 'forming' voltage is applied between the electrode films, the front electrode film being biassed positively, for a period lasting from a fraction of an hour to several days depending on the particular panel required. The impedance of the panel gradually increases during this period so the applied voltage is correspondingly increased steadily from a low value, typically zero volts, to a maximum value, typically 80–100 volts, to maintain the consumed power approximately constant. The electric current ('forming' current) passing through the panel produces a narrow high resistivity light emitting barrier (typically a micron thick) near the positive front electrode film and it is the gradual formation of this region which causes the increase in panel impedance.

Examples of conventional formed panels are described in U.K. Patent specification Nos. 1,300,548 and 1,412,268.

Forming of DCEL panels, is a costly process when carried out on a commercial scale by the panel manufacturer and is difficult to carry out reproducibly. The purpose of the present invention is to provide a DCEL panel requiring little or no forming.

According to the present invention a method of making an electroluminescent phosphor panel suitable for unidirectional voltage operation (a DCEL panel) includes the steps of providing a transparent first electrode film on a transparent electrically insulating substrate, depositing on the first electrode film a first layer of an activator-doped phosphor which is semi-insulating and which has an average thickness less than 5 microns, depositing on the first layer a second layer of a phosphor which is conducting, and providing a second electrode film on the second layer.

The first layer may consist of several sub-layers separately deposited and each containing the same or a different activator.

The second layer of phosphor may or may not be activator doped. If doped then the activator may be the same as or different from the first layer activator.

According to another aspect of the invention there is provided a DCEL panel produced by the above method.

The substrate may be of glass, the first electrode film may be of tin oxide, InO, or InSnO and the second electrode film may be of aluminium.

The phosphor of the first and second layers may be ZnS, ZnSe, a ZnS-ZnSe alloy, ZnO, a ZnS-ZnO alloy or a sulphide of copper (in its semi-insulating phase if used for the first layer). The activator of the first and second layers is preferably Mn although it may alternatively be Pb, Zr, V, Cr, Mo, U, Tb or other ions with unfilled inner electron shells such as rare earths.

The conductor contained in the second layer is preferably copper.

The first layer preferably has a thickness between 200 Å and 1 micron depending on the required operation voltage and a resistivity which is preferably greater than $10^9$ohms-cm.

The second layer preferably has a resistivity less than $10^4$ohms-cm. Its thickness is not critical but may be about 50 microns for example.

When the forming process is applied to a conventional DCEL panel the narrow high resistivity region near the positive front electrode film is produced by the migration of copper ions away from this film into the interior of the phosphor layer. During subsequent use of the panel when an operating voltage is applied across the phosphor layer a high electric field is created in the narrow copper depleted region. It is believed that electrons are injected from the interior of the phosphor layer into this region with a high energy causing excitation of the atoms in the region. The activator atoms in the region dissipate their excess energy gained by this mechanism by a radiative transition, i.e., by emitting light.

In a DCEL panel produced according to the invention the second layer provides electron injection similar to that from the interior of the phosphor layer in a conventional panel whilst the first layer provides a high field light emitting region similar to the copper depleted region of a conventional panel. A DCEL panel according to the invention may be suitable for use without any forming at all; alternatively it will require only reduced forming (in time and/or current consumed) to fill in any pin holes in the first layer. However it will be capable of operating in a similar way and under similar conditions to a fully formed conventional DCEL panel.

Embodiments of the invention will now be described by way of example with reference to the accompanying drawing which is a cross-sectional view of a DCEL panel.

As shown in the drawing the panel indicated by a reference numeral 2 includes a transparent conducting tin oxide film 3 laid, e.g. by sputtering, on part of the upper surface of a glass substrate 1. The film 3 may be selectively etched in the form of characters, symbols or stripes (not shown) to define display elements. A semi-insulating phosphor layer 5 is deposited on the film 3 and a conducting phosphor layer 7 is deposited on the layer 5. One end of the layers 5 and 7 is coated with an insulating material 9 e.g. $SiO_2$. An aluminium film 11 is evaporated on the layer 3, the insulating material 9 and the exposed part of the glass substrate 1. If the film 3 is selectively etched the film 11 is correspondingly etched in appropriate regions. If the film 3 is in the form of stripes then the film 11 is etched in the form of perpendicular stripes to define a conventional matrix configuration; otherwise the films 3 and 11 are etched to give the same electrode form. A resin jacket 15 is provided to cover the upper surface of the panel 2 for encapsulation purposes.

The layer 5, which may have a thickness of from 200 Å to 1 micron, may be of ZnS doped with Mn. It may be deposited on the film 3 in any of the ways known for depositing so-called monolayers on substrates. For example the layer 5 may be sputtered, evaporated, electrophoretically plated, brushed on, or blown on by air. The layer 5 may or may not be mixed with a binder (e.g. polymethylmethacrylate) to improve its adherence to the film 3.

The layer 7, which may have a thickness of about 50 microns may consist of grains of manganese doped zinc sulphide coated with copper in a conventional way and spread on the layer 5 in a binder, e.g. polymethylmethacrylate, in a conventional way. For example the second layer may be evaporated or sputtered, and in this case it may be advantageous to place a third conducting layer between the second layer and the back electrode so that the display absorbs incident light giving a greatly improved appearance in high ambient illumination. Additionally if layer 7 is a powder layer it might contain a dark dye to give improved contrast. Alternatively, the layer 7 may be silk screen printed on the layer 5.

If the layers 5 and 7 both include binders deposited with the aid of a solvent (which is allowed to evaporate) the binder or solvent used for the layer 5 should not be soluble in the solvent used for the layer 7 otherwise the layer 5 can be seriously degraded.

As noted above, when the panel 2 has been produced it may or may not require the application of a limited forming current. In either case when it is ready for use operating voltages are applied between the film 3 and the film 11 or parts, e.g. stripes, thereof (not shown), causing light emission to occur from the layer 5 in the form of a display.

The light is observed through the glass substrate 1.

I claim:

1. An electroluminescent phosphor panel suitable for unidirectional voltage operations comprising in serial order, a transparent electrically insulating substrate, a transparent first electrode film, a first layer of semi-insulating activator doped phosphor with an average thickness less than 5 microns, a second layer of an electrically conducting phosphor, and a second electrode film.

2. A panel according to claim 1 wherein the second layer is activator doped.

3. A panel according to claim 1 wherein the phosphor of the first and second layers is a material selected from the group containing zinc sulphide, zinc selenium, a zinc sulphide-zinc selenium alloy, zinc oxide, a zinc sulphide, zinc oxide alloy, and a sulphide of copper.

4. A panel according to claim 3 wherein the activator is an element chosen from the group containing manganese, lead, zirconium, vanadium, chromium, molybdenum, uranium, and terbium.

5. A panel according to claim 4 wherein the phosphor of the second layer is granular in form with copper coated grains.

6. A panel according to claim 4 wherein the thickness of the first layer is between 200 Å and 1 micron.

7. A panel according to claim 4 wherein the resistivity of the first layer is greater than $10^9$ohm-cm.

8. A panel according to claim 4 wherein the resistivity of the second layer is less than $10^4$ohm-cm.

9. A panel according to claim 4 and further comprising an encapsulating jacket fixed to the substrate and covering the first and second layers and at least part of the second electrode film.

10. A panel according to claim 1 wherein the first layer comprises several sublayers separately deposited.

11. An electroluminescent phosphor panel suitable for unidirectional voltage operation comprising in serial order, a transparent electrically insulating substrate, a transparent first electrole film, a first layer of semi-insulating manganese doped zinc sulphide with an average thickness between 200 Å and 1 micron and a resistivity greater than $10^9$ohm-cm, a second layer of an electrically conducting manganese doped zinc sulphide containing copper and having the resistivity less than $10^4$ohms-cm, a second electrode film, and an encapsulating jacket fixed to the substrate to cover the first and second layers and at least part of the first and second films.

* * * * *